US007088085B2

(12) United States Patent
Marinca

(10) Patent No.: US 7,088,085 B2
(45) Date of Patent: Aug. 8, 2006

(54) CMOS BANDGAP CURRENT AND VOLTAGE GENERATOR

(75) Inventor: Stefan Marinca, Limerick (IE)

(73) Assignee: Analog-Devices, Inc., Norwood, MA (US)

( * ) Notice: Subject to any disclaimer, the term of this patent is extended or adjusted under 35 U.S.C. 154(b) by 251 days.

(21) Appl. No.: 10/613,177

(22) Filed: Jul. 3, 2003

(65) Prior Publication Data

US 2005/0001605 A1 Jan. 6, 2005

(51) Int. Cl.
*G05F 3/16* (2006.01)
*G05F 1/10* (2006.01)

(52) U.S. Cl. ..... 323/314; 323/315; 327/538

(58) Field of Classification Search ..... 323/313, 323/314, 315, 316, 317, 907; 327/538, 539, 327/540, 542

See application file for complete search history.

(56) References Cited

U.S. PATENT DOCUMENTS 4,751,454 A * 6/1988 Dielacher et al. ..... 323/314
5,126,653 A 6/1992 Ganesan et al.
5,357,216 A * 10/1994 Nguyen ..... 331/25
5,821,807 A 10/1998 Brooks
6,002,244 A * 12/1999 Wrathall ..... 323/315
6,046,578 A * 4/2000 Feldtkeller ..... 323/314
6,150,872 A * 11/2000 McNeill et al. ..... 327/539
6,563,371 B1 * 5/2003 Buckley et al. ..... 327/539
2002/0163379 A1 11/2002 Kimura

OTHER PUBLICATIONS

Dos Reis Filho, Carlos A. et al, "Elements for a monolithically integrated rotation imbalance detector", IEEE, vol. 2, Jun. 9, 2003, pp. 897–900.

Bakker, M.A.P. Pertijs, et al, "A high–accuracy temperature sensor with seond–order curvature correction and digital bus interface", IEEE, vol. 1, May 6, 2001, pp. 368–371.

* cited by examiner

*Primary Examiner*—Rajnikant B. Patel
(74) *Attorney, Agent, or Firm*—Wolf Greenfield & Sacks, P.C.

(57) ABSTRACT

The present invention provides an improved reference source. The reference source has reduced sensitivity to the input offset voltage of the amplifier components in the reference circuit. This is achieved by subtracting two currents at the reference output node such that the combined offset sensitivity is less than the corresponding offset sensitivity for only one current.

28 Claims, 5 Drawing Sheets

CM OS BANDGAP CURRENT AND VOLTAGE GENERATOR

FIELD OF THE INVENTION

The present invention relates to bandgap current and voltage generators. More particularly, it relates to bandgap current and voltage generators which have a reduced sensitivity to voltage offset errors and which can also operate at a low supply voltage.

BACKGROUND OF THE INVENTION

Bandgap voltage reference circuits are well known in the art from the early 1970's as is evidenced by the IEEE publications of Robert Widlar (IEEE Journal of Solid State Circuits Vol. SC-6 No 1 February 1971) and A. Paul Brokaw (IEEE Journal of Solid State Circuits Vol. SC-9 No 6 December 1974).

These circuits implement configurations for the realization of a stabilized bandgap voltage. As discussed in David A. Johns and Ken Martin "Analog Integrated Circuit Design", John Wiley & Sons, 1997, these circuits and other modifications to same are based on the addition of two voltages having equal and opposite temperature coefficients. This is typically achieved by adding the voltage of a forward biased diode (or base emitter junction voltage) which is complementary to absolute temperature and therefore decreases with absolute temperature (a CTAT voltage) to a voltage which is proportional to absolute temperature and therefore increases with absolute temperature (a PTAT voltage). Typically, the PTAT voltage is formed by amplifying the voltage difference ($\Delta V_{be}$) of two forward biased base-emitter junctions of bipolar transistors operating at different current densities.

FIG. 1 shows a schematic of such a typical bandgap voltage reference on a CMOS process according to the prior art. It comprises an operational amplifier A, two resistors, r1 and r2, two bipolar transistors Q1 and Q2, and three PMOS devices M1, M2 and M3 arranged as current mirrors. The output of the amplifier A is coupled to the drain of the diode connected PMOS MOSFET M1 and also to the gates of MOSFETS M1, M2 and M3. The sources of M1, M2 and M3 are coupled to the power supply, Vdd. The drain of M2 is coupled to the inverting input of the amplifier A. The drain of M3 is coupled to the emitter of transistor Q1 via resistor r2. The inverting input of the amplifier A is coupled to the emitter of the second transistor Q2 via resistor r1. The emitter area of Q2 is a scalar multiple (n2) the emitter area of Q1. The non-inverting input of the amplifier A is coupled to the emitter of transistor Q1. The bases and collectors of Q1 and Q2 are coupled to ground.

The CTAT voltage is the base-emitter voltage of a forward biased transistor, as mentioned previously. It will be appreciated by those skilled in the art that the temperature dependence of the base emitter voltage may be expressed as:

$$Vbe(T) = V_{G0}\left(1 - \frac{T}{T_0}\right) + V_{be0}\frac{T}{T_0} - \sigma\frac{kT}{q}\ln\left(\frac{T}{T_0}\right) + \frac{kT}{q}\ln\left(\frac{Ic}{Ic_0}\right) \quad (1)$$

where $V_{be}(T)$ is the temperature dependence of the base-emitter voltage for the bipolar transistor at operating temperature, $V_{be0}$ is the base-emitter voltage for the bipolar transistor at a reference temperature, Ic is the collector current at the operating temperature, Ic0 is the collector current at the reference temperature, k is the boltzmann constant, q is the charge on the electron, T is the operating temperature in Kelvin, $V_{G0}$ is the bandgap voltage or base-emitter voltage at the reference temperature, $T_0$ is the reference temperature, and σ is the saturation current temperature exponent.

The first two terms in this equation demonstrate the linear decrease of the base-emitter voltage as temperature is increasing. Thus, it can be seen that the base-emitter voltage is a CTAT voltage, as stated previously.

The two bipolar transistors, Q1 and Q2, of FIG. 1 are used to generate the required PTAT voltage. As the emitter area of Q2 is n2 times the emitter area of Q1, and the current flowing into the emitter of Q1 is n1 times greater compared to the emitter current of Q2, Q1 operates at a higher current density than Q2. The ratio of the two emitter current densities is then n1*n2.

This relationship between the current densities of Q1 and Q2 enables the generation of the PTAT voltage as follows. In operation, the amplifier A forces respective currents Ip, Ip and n1*Ip from feedback mirrors M1, M2 and M3 as feedback currents, which ensures that the two amplifier inputs settle when they have substantially the same potential. As a result, a PTAT voltage, being the base-emitter voltage difference between Q1 and Q2, develops across the resistor r1 as a voltage drop of current Ip. The PTAT voltage can be expressed in the following equation:

$$\Delta V_{be} = \frac{kT}{q}\ln(n1 \cdot n2) \quad (2)$$

It will be understood therefore that both PTAT and CTAT voltages are provided at the inputs to the amplifier. This addition of the PTAT and CTAT voltages at the amplifier results in the generation of a reference voltage which is substantially temperature independent for a specific combination of resistor ratios (r2/r1) and current density.

There are several limitations on bandgap voltage reference sources as described above. The first limitation is the process in which the reference source has to be implemented. For precision, a bipolar process is preferred. This is because bipolar transistors have a smaller offset when compared to MOS transistors. From a cost point of view, a CMOS process is preferred. However, when bipolar transistors are implemented in CMOS technology, only parasitic bipolar transistors are available. Typically, a parasitic bipolar transistor may be a substrate bipolar transistor having only two terminals available, namely the base and emitter, with the third terminal, the collector, being connected to the substrate. This results in severe design limitations.

A second source of error in CMOS bandgap reference sources is caused by amplifier and current mirror offsets, mainly due to the CMOS process variations in a CMOS transistor.

As the market trend is to move to a lower supply voltage, the minimum supply voltage of a device is an important factor. As a result, typically there is a trade-off between minimum supply voltage and errors in reference performance, expressed in what is commonly accepted "statistical standard deviation" or "sigma".

Let us annotate the base-emitter voltage of the bipolar transistor operating at high current density (Q1 in FIG. 1) as $V_{be1}$, since it usually has a unity emitter area. Let us also annotate the base-emitter voltage of the transistor operating at low current density (Q2 in FIG. 1) $V_{ben}$, as it usually has an emitter area n (n2 in FIG. 1) times larger than Q1. If we assume that Q1 operates at a collector current of the order of μA and the collector current density ratio of Q1 to Q2 is 50 at room temperature, these values are about: $V_{be1}$=700 mV, $V_{ben}$=600 mV, and the difference between them, $\Delta V_{be}$=100 mV. A typical bandgap voltage based on summation of a CTAT and PTAT voltage is about 1.2V. As a result, the PTAT voltage (which is the voltage drop across r2 in FIG. 1) should be of the order of 500 mV and the resistor ratio in FIG. 1, r2/r1, is 5. If the amplifier in FIG. 1 has an offset voltage $V_{off}$, then the output voltage offset is $$V_{out_off} = V_{off}\left(1 + \frac{r2}{r1}\right) = V_{off} * 6 \tag{3}$$

As a result, each millivolt in offset voltage is reflected as 6 mV into the reference voltage. It will be appreciated that this ratio of offset voltage to reference voltage is quite substantial. The circuit according to FIG. 1 can operate at low supply voltage, as the common input voltage for the amplifier is $V_{be1}$.

FIG. 2 shows another prior art circuit which aims to reduce the sensitivity of the reference voltage to the amplifier's offset. FIG. 2 achieves this by increasing the voltage drop across resistor r1 by stacking base-emitter voltages as shown, so that the amplifier's offset voltage $\Delta V_{be}$ is increased before amplification. An increase in the voltage drop decreases the ratio of the offset voltage to the input voltage of the amplifier, and thus decreases the sensitivity of the reference voltage to the amplifier offset voltage.

The difference between FIG. 1 and FIG. 2 is the inclusion of two additional bipolar transistors, Q3 and Q4, and two additional PMOS transistors, M4 and M5, so as to provide a stacked transistor configuration. The emitter of Q1 in FIG. 2 is now coupled directly to the drain of PMOS M3. The base of Q1 is now connected to the emitter of a transistor Q3, having the same emitter area as Q1. A PMOS MOSFET M4 is coupled to the emitter of transistor Q3 via resistor r2. The base of transistor Q2 is coupled to the emitter of a transistor Q4. The emitter of transistor Q4 is also coupled to the drain of a MOSFET M5. The bases of Q4 and Q3 are coupled to ground. The emitter areas of Q2 and Q4 are selected so as to be greater than the emitter areas of Q1 and Q3. This ensures that the emitter and collector current densities of Q1 and Q3 will be higher than the corresponding current densities of Q2 and Q4.

It will be appreciated that the addition of such a transistor stack results in the voltage drop over resistor r1 in the circuit of FIG. 2 being larger than the voltage drop across r1 for the circuit of FIG. 1. This voltage drop can be expressed as:

$$\Delta Vbe = \frac{kT}{q}\ln(n1 \cdot n2 \cdot n3 \cdot n4) \tag{4}$$

The voltage drop across r1 is twice $\Delta V_{be}$ and in order to generate a PTAT voltage of $5\Delta V_{be}$, we need a gain of 2.5. Accordingly the output offset voltage is:

$$V_{out_off} = V_{off}\left(1 + \frac{r2}{r1}\right) = V_{off} * 3.5 \tag{5}$$

However, while the voltage reference source circuit of FIG. 2 reduces the reference voltage sensitivity to the amplifier's voltage offset, this circuit needs a higher supply voltage when compared to the circuit of FIG. 1, as the amplifier's input voltage is now 2 $V_{be1}$. It will be appreciated, therefore, that this circuit has the disadvantage that it cannot be implemented where a low supply voltage is required or provided.

U.S. Pat. No. 6,507,180, entitled "Bandgap Reference Circuit with Reduced Output Error", discloses a further design, which focuses on a reduction in the sensitivity of the reference source to offset voltage. The invention discloses a bandgap reference circuit capable of reducing an error with respect to a designed reference voltage and a temperature drift. This patent application is incorporated herein by reference. It comprises a first, second and a third serial circuit constituting a feedback control circuit in combination, as shown in FIG. 2 of the patent specification. The feedback control circuit is designed so that it reduces the influence of an offset voltage on the reference source and therefore the reference source voltage error. According to the results as disclosed in the patent specification, the invention results in a reduced output error component of 14.5 mV and an error ratio of 1.23. This result compares favorably with the error component of a conventional bandgap reference source, which is typically of the order of 22.5 mV with an error ratio of 1.77.

Although this is an improvement, the influence of an offset voltage on the reference source is quite high. There is therefore still a requirement to provide a reference source with reduced sensitivity to voltage offset and which can also operate at low supply voltages.

SUMMARY OF THE INVENTION

Accordingly, the present invention provides a CMOS bandgap current and voltage generator with reduced sensitivity to voltage offset, which can operate at low supply voltages.

In a first embodiment, the present invention provides a reference source comprising:

- a first bipolar transistor circuit having one or more bipolar transistors for operation at a high current density to provide an output $V_{be1}$,
- a second bipolar transistor circuit having one or more bipolar transistors for operation at a lower current density than that of the first transistor block to provide an output $V_{ben}$,
- a first control circuit,
- a second control circuit,
- a current source, and
- a current sink, wherein outputs of the first and second transistor circuits are fed to the first and second control circuits, the first control circuit being adapted to control the current provided by the current source and the second control circuit being adapted to control the current provided by the current sink, and outputs of the current source and current sink being combined to provide an output of the reference source.

The current source and current sink provide outputs equal to a scaled difference between the outputs of the first and second transistor circuits.

In one embodiment, the output of the current source may be defined by the equation:

$$N1V_{be1} - N2V_{ben}$$

where N1>N2, and the output of the current sink is defined by the equation $$N3V_{ben}-N4V_{be1}$$

where N3>N4.

Suitably, the output of the reference source may be defined by the equation:

$$(N1+N4)V_{be1}-(N2+N3)V_{ben}$$

The first and second control circuits may be adapted to provide the output of the reference source as a predominant PTAT or CTAT output.

The output of the reference source may be provided as a current reference output.

Alternatively, the output of the reference source may be provided as a voltage reference output.

Each of the first and second control circuits may include at least one amplifier.

A first resistor may be coupled to a non-inverting input of an amplifier of the first control circuit and a second resistor may be coupled to an inverting input of an amplifier of the second control circuit, the ratio of the first and second resistors determining the dominance of PTAT to CTAT at the output of the reference source.

Suitably, the first bipolar transistor circuit includes a stacked arrangement of transistors; and the first control circuit includes an amplifier, the stacked arrangement of transistors being coupled to a non-inverting input of the amplifier via the first resistor, and the output of the amplifier being coupled to a current mirror to provide the current provided by the current source.

Suitably, the output of the amplifier of the first control circuit is coupled to a first pair of MOSFETs, the current provided at the first MOSFET of the pair by the amplifier being replicated to form an output of the second MOSFET of the pair, and the output of the second MOSFET being replicated across a current mirror, defined by a second pair of MOSFETs.

Suitably, the second bipolar transistor circuit is coupled to an non-inverting input of an amplifier component of the second control circuit, the output of the amplifier component controlling the gate of a MOSFET transistor to provide the current provided by the current sink.

In a particular embodiment, the first bipolar transistor circuit includes a stacked arrangement of transistors, the first control circuit includes an amplifier, the tacked arrangement of transistors being coupled to the non-inverting input of the amplifier via the first resistor, and the output of the amplifier being coupled to a current mirror to provide the current provided by the current source, the second bipolar transistor circuit is coupled to an non-inverting input of an amplifier component of the second control circuit, the output of the amplifier component controlling the gate of a MOSFET transistor to provide the current provided by the current sink, and the second bipolar transistor circuit is additionally coupled to the inverting input of the amplifier of the first control circuit.

Preferably, the circuit components are implemented in CMOS technology.

The present invention also provides a method of providing a reference source for a circuit requiring a reference source, the method comprising the following steps:

providing a first bipolar transistor circuit having one of more bipolar transistors for operation at a high current density to provide an output $V_{be1}$, providing a second bipolar transistor circuit having one of more bipolar transistors for operation at a lower current density than that of the first transistor block to provide an output $V_{ben}$, providing a first control circuit, providing a second control circuit, providing a current source, and providing a current sink, wherein outputs of the first and second transistor circuits are fed to the first and second control circuits, the first control circuit being adapted to control the current provided by the current source and the second control circuit being adapted to control the current provided by the current sink, outputs of the current source and current sink being combined to form an output of the reference source, and the output of the reference source being provided to the circuit requiring the reference source.

These and other features of the present invention will be better understood with reference to the following drawings.

DETAILED DESCRIPTION OF THE DRAWINGS

Figure 1:
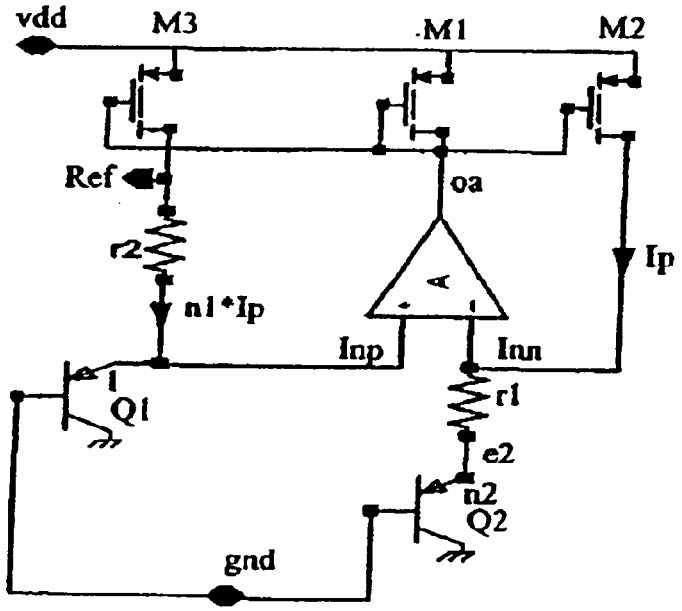
Fig. 1 (PRIOR ART)
FIG. 1 shows a schematic of a bandgap voltage reference source according to the prior art.
Figure 2:
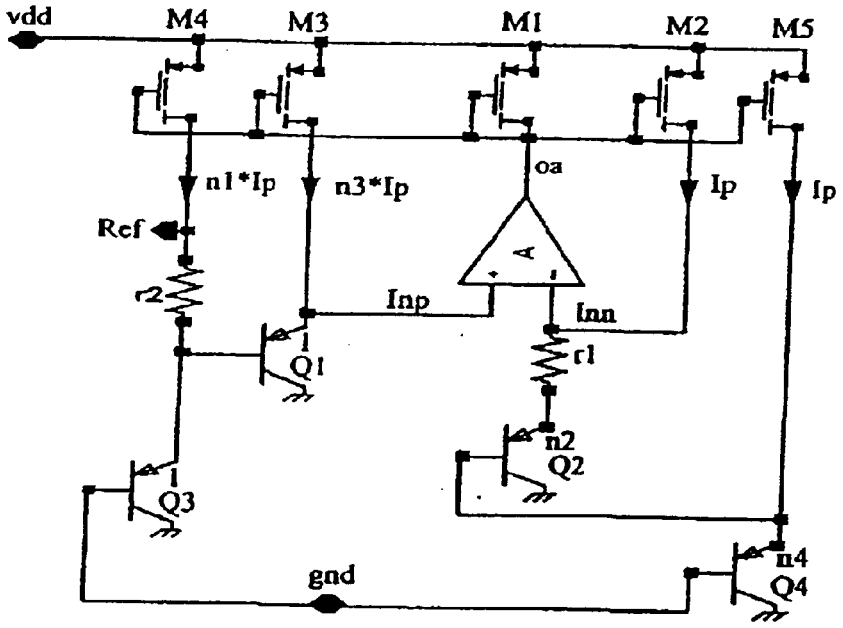
Fig.2 (PRIOR ART)
FIG. 2 shows a schematic of a stacked bandgap voltage reference source according to the prior art.

FIGS. 1 and 2 have been described in the background of the invention section with reference to the prior art.

The present invention will now be described with reference to the accompanying FIGS. 3 to 6.

Figure 3:
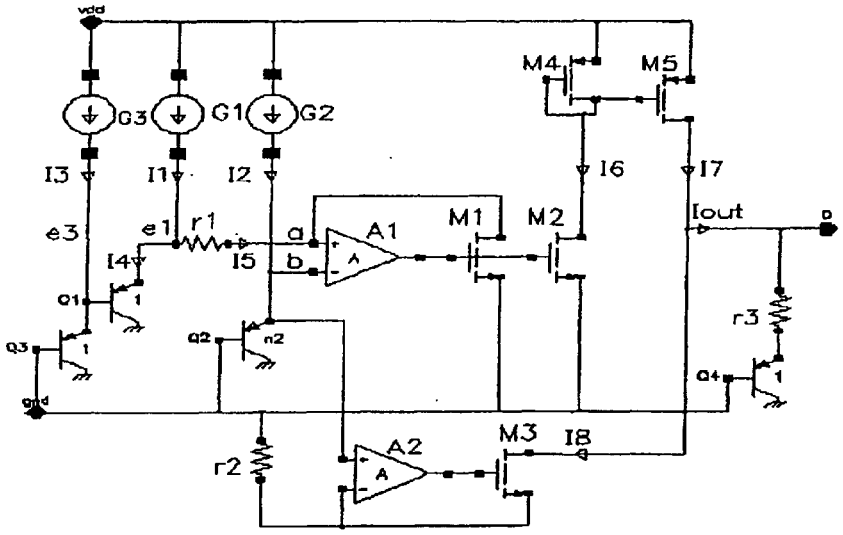
FIG. 3 shows a schematic of a reference source according to a first embodiment of the present invention.

FIG. 3 shows a schematic of a first embodiment of a CMOS bandgap current and voltage generator according to the present invention. It comprises two operational amplifiers A1 and A2, two PMOS transistors M4 and M5, three NMOS transistors M1, M2 and M3, three current sources, G1, G2 and G3, four bipolar transistors Q1 to Q4, and three resistors, r1, r2 and r3.

The amplifier A1 has a non-inverting node, "a", and an inverting node, "b". The output node of the amplifier A1 is coupled to the common gate of NMOS transistors M1 and M2. M1 and M2 are provided in a current mirror configuration, and the drain of M2 is coupled to the drain of PMOS diode connected MOSFET M4. The drain of M1 is coupled in a feedback loop to the non-inverting input "a" of amplifier A1. The gates of M4 and M5 are coupled together. The sources of M4 and M5, and the current sources G1, G2 and G3 are coupled to Vdd. Current source G2 is also coupled to the emitter of transistor Q2. Current source G3 is coupled to the emitter of transistor Q3, while current source G1 is coupled to the emitter of transistor Q1. The emitter of Q3 is additionally coupled to the base of Q1. The inverting input "b" of amplifier A1 is coupled to the emitter of Q2. The non-inverting input "a" of amplifier A1 is coupled to the emitter of Q1 via resistor r1. Q1 and Q3 are unity emitter area, while the emitter area of Q2 has a value of n2 times said unity emitter area. The bases of Q2 and Q3 and the sources of M1 and M2 are coupled to ground. The emitter of transistor Q2 is coupled to the non-inverting terminal of amplifier A2. A resistor r2 is coupled between the inverting terminal of A2 and ground. The output of the amplifier A2 is coupled to the gate of a MOSFET M3. The source of M3 is coupled to the inverting input of amplifier A2. The drain of M3 is coupled to the drain of MOSFET M5. The output reference current of the reference source circuit is taken at the common drain of MOSFETs M5 and M3. A resistor r3 is coupled between the common drain of M5 and M3 and the emitter of a transistor Q4. The base of the transistor Q4 is coupled to ground. The collectors of all the transistors Q1 to Q4 are coupled to ground.

It will be appreciated that the three current sources, shown in FIG. 3 as G1, G2 and G3, provide a biasing current to the circuit. These current sources may be provided by mirroring the current provided by the current mirror M4, M5 to appropriate device inputs, or alternatively may be provided on-chip as provided by the embodiments of the present invention described here. It will further be appreciated that the biasing current may be produced by any of a number of suitable devices.

The operation of the circuit will be described in detail in the following sections.

The circuit of FIG. 3 has two paths from the input of the amplifier A1 to the output. The first path is from node e1, (between the emitter of Q1 and resistor r1), through node "a" at the non-inverting input of A1, onto current mirrors M1, M2, M4, M5, to the output. The second path is from node "b" at the inverting input of A1 to the output, via the feedback MOS transistor M3. If the current mirrors M1 to M5 are well matched then the current I7, which is forced into the output node, is:

$$I_7 = I_{r1} = \frac{2V_{be1} - V_{ben}}{r1} \tag{6}$$

The current from the second path, I8, is pulled from the output node. This current is:

$$I_8 = I_{r2} = \frac{V_{ben}}{r2} \tag{7}$$

Then the output current is:

$$I_{out} = I_7 - I_8 = \frac{2V_{be1} - V_{ben}}{r1} - \frac{V_{ben}}{r2} \tag{8}$$

Depending on the ratio of the resistors to one another, the output current can be programmed to be dominant CTAT, dominant PTAT or purely PTAT. To provide a PTAT current at the output, r1 should be chosen to be equal to r2.

If a reference voltage is to be generated, it will be appreciated that it is necessary to provide a load at the output, across which the current may be converted to a corresponding voltage. In the embodiment of FIG. 3, this is provided by a third resistor r3 and a transistor Q4, such that $V_{be1}$ is added to a voltage drop of $I_{out}$ across the third resistor r3. The voltage reference will be:

$$V_{ref} = 2\Delta V_{be} * \frac{r3}{r1} + V_{be1} \tag{9}$$

As $\Delta V_{be}$ needs to be reflected outside by a gain of 5, it will be appreciated that the ratio of r3/r1 has to be 5/2=2.5.

The offsets of the two amplifiers in FIG. 3 will, however, alter the precision of the reference source. Statistically, the two corresponding offsets will generate a compound offset. Assuming that the two amplifiers in FIG. 3 have the same input offset voltage $V_{off}$ and this is the same as "sigma" or σ, the statistical output compound offset can then be expressed as:

$$V_{off_out} = \left(\sqrt{(V_{off})^2 + (V_{off})^2}\right)\frac{r3}{r1} = \sqrt{2}\,V_{off}\frac{r3}{r1} = 3.54\ V_{off} \tag{10}$$

From an examination of the circuit of FIG. 3 it will be understood that the circuit operates at a lower voltage when compared to the circuits of FIG. 1 and FIG. 2, while still maintaining substantially the same offset sensitivity as the circuit of FIG. 2.

Figure 4:
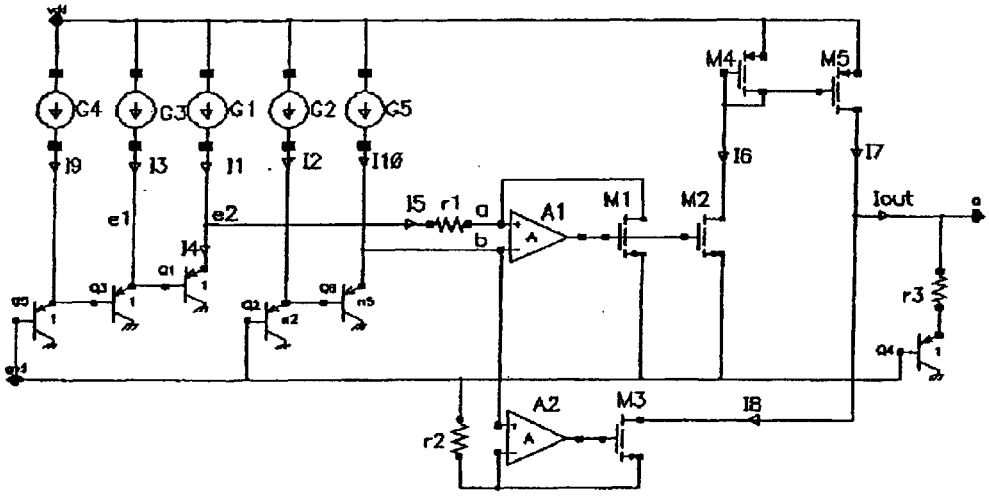
FIG. 4 shows an implementation of a reference source according to a second embodiment of the present invention.

FIG. 4 shows a second embodiment of the reference source circuit of the present invention. The circuit is similar to the circuit of FIG. 3, with the addition of two further bipolar transistors, Q5 and Q6 and two further current sources, G4 and G5. In the circuit of FIG. 4, the base of Q3 is now connected to the emitter of a transistor Q5. A current source G4 is coupled to the emitter of transistor Q5. The inverting input "b" of amplifier A1 is now coupled to the emitter of a transistor Q6. The emitter of Q6 is also coupled to a current source G5. The base of the transistor Q6 is coupled to the emitter of transistor Q2. The base of Q5 and collector of Q6 are coupled to ground.

The circuit of FIG. 4 has two unbalanced bipolar transistor stacks, one stack having three transistors of unity emitter area, Q1, Q3, and Q5, and the second stack two transistors of large emitter area, Q2 and Q6. The first path generates a current I7 of:

$$I_7 = I_{r1} = \frac{3V_{be1} - 2V_{ben}}{r1} \tag{11}$$

and the second a current of:

$$I_8 = I_{r2} = \frac{2V_{ben}}{r2} \tag{12}$$

If r1=r3=r2/2 then the output voltage will be:

$$V_{ref} = 3\Delta V_{be} * \frac{r3}{r1} + V_{be1} \tag{13}$$

In order to generate at the output a PTAT voltage of $5\Delta V_{be}$, the gain factor (r3/r1) needs to be 5/3. However, the gain factor for the second path is 5/(2*3). The offset sensitivity is now dominant for the first path,. as the gain for the second path is 0.5 compared to the first path. The compound output voltage offset then becomes for the circuit of FIG. 4:

$$V_{\text{off_out}} = \left(\sqrt{(V_{off})^2 + \left(\frac{1}{2}V_{off}\right)^2}\right)\frac{r3}{r1} = \sqrt{\frac{3}{2}}\,\frac{5}{3}V_{off} = 2.04V_{off} \tag{14}$$

Therefore, it will be appreciated that the circuit of FIG. 4 provides a current reference source where the sensitivity of the amplifiers A1 and A2 due to the input offset voltage is less than the amplifier's sensitivity in the circuits of the prior art. As the input voltage to both amplifiers is lower, the amplifiers can operate with a lower supply voltage and therefore are capable of operation in lower headroom environments.

Figure 5:
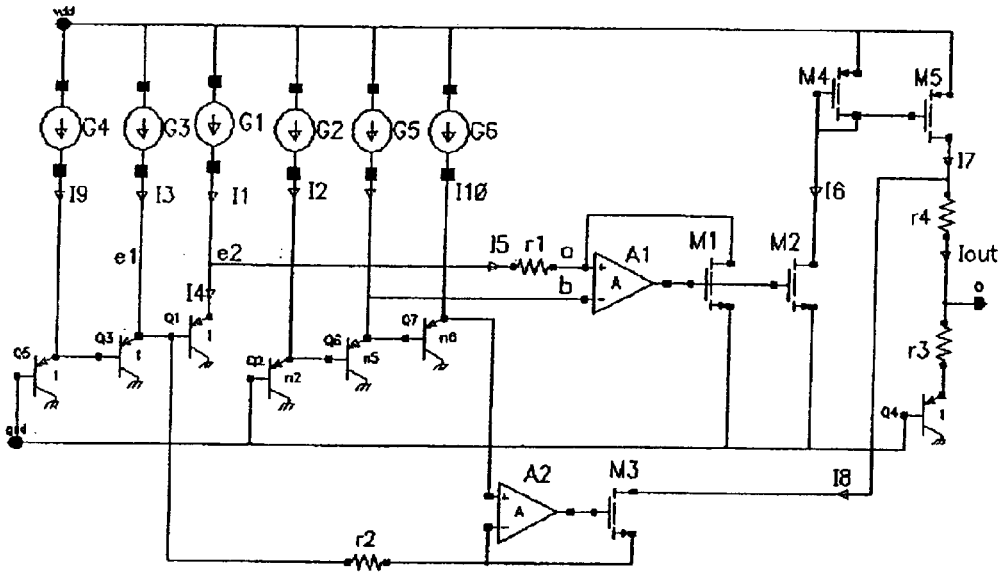
FIG. 5 shows a reference source according to a third embodiment of the present invention.

FIG. 5 illustrates a third embodiment of reference source of the present invention. The circuit of FIG. 5 is similar to the circuit of FIG. 4, with the addition of one further resistor, r4, and transistor, Q7, and a current source G6. The emitter of Q6 is coupled in the circuit of FIG. 5 to the base of a transistor Q7. The non-inverting input of amplifier A2 is now coupled to the emitter of Q7. The current source G6 is coupled to the emitter of transistor Q7. The collector of Q7 is tied to ground. The resistor r2 is now coupled between the emitter of Q3 and the inverting input of amplifier A2. Resistor r4 is coupled between resistor r3 and the source of M5.

The circuit of FIG. 5 has two balanced bipolar transistor stacks, one stack having three transistors of unity emitter area, Q1, Q3 and Q5, and the second stack having three transistors of larger emitter area, Q2, Q6 and Q7. The current into the first path is generated from the difference of three base-emitter voltages of the transistors operating at high current density to two base-emitter voltages for the transistors operating at low current density. The current into the second path is generated from the difference of three base-emitter voltages of the transistors operating at low current density to two base-emitter voltages for the transistors operating at high current density. In this way, $5\Delta V_{be}$ will be generated and the three resistors, r1, r2, r3, have the same value. New resistor r4 ensures that the drain of M3 will be always more positive compared to its source.

The first path generates a current I7 of:

$$I_7 = I_{r1} = \frac{3V_{be1} - 2V_{ben}}{r1} \tag{15}$$

and the second path a current:

$$I_8 = I_{r2} = \frac{3V_{ben} - 2Vbe1}{r2} \tag{16}$$

The output current is:

$$I_{out} = I_{r1} - I_{r2} = \frac{3V_{be1} - 2V_{ben}}{r1} - \frac{3V_{ben} - 2Vbe1}{r2} = \frac{5\Delta V_{be}}{r1} \tag{17}$$

In this embodiment, the compound output offset voltage is:

$$V_{\text{off_out}} = \left(\sqrt{(V_{off})^2 + (V_{off})^2}\right)\frac{r3}{r1} = \sqrt{2}\,V_{off} = 1.41V_{off} \tag{18}$$

Comparing FIG. 5 to FIG. 2, it will be appreciated that the sensitivity of the reference voltage to the offset of the amplifiers A1 and A2 for FIG. 5 is again lower than that of FIG. 2.

If the amplifiers A1 and A2 are chosen to have the same offset, the output offset as detected at the output node will be zero, and this, it will be appreciated, will be of great benefit to designers.

The matching of the offsets of the two amplifiers may be effected in a number of different manners. For example, at the trim stage, the offset may be matched by adjusting the offset of the first amplifier to that of the other. In an alternative embodiment, the two amplifiers may be swapped during operation using for example multiplexers, by providing a signal and connecting the equivalent two inputs and outputs of each amplifier.

It will be understood that although the offset may be provided with a zero value at room temperature, it is susceptible to drift with temperature. Therefore, although the offset may be cancelled at one temperature, it will change with temperature. However, by providing matched amplifiers, it will be appreciated that the drift will be compensated.

It will be appreciated by those skilled in the art that there may be a difference between the drain current of MOSFETs M1 and M2, as their drains have different voltages. As the current applied to M1 is replicated across to M2, due to the finite output resistance of M1 and M2, it may introduce mismatch into the output currents of M1 and M2 and a subsequent error in the output. This may detract from the overall advantage of the implementations of the present invention. In order to obviate the possibility of such mismatch affecting the output, modifications can be made to the circuits of FIGS. 3 to 5, as will be appreciated by those skilled in the art. This unwanted effect may be obviated by equalising the drain voltage of the two MOSFETs. This may be achieved in a number of different manners. For example, the addition of an external amplifier and an associated NMOS transistor may be used to equalise the drain voltages.

If used, this associated NMOS transistor would be located in the path between the drains of M2 and M4. The output of the external amplifier would then be connected to the gate of the NMOS transistor. The drain of M1 would be connected to the non-inverting input of the external amplifier, while the drain of M2 would be connected to the inverting input of the external amplifier. As such, the amplifier will operate to equalise the two drain currents. In a further example, the mismatch between the drain currents of M1 and M2 may be equalised by providing M1 and M2 with large areas and a long channel. It will be understood that the effect of any mismatch is particularly important for the examples of M1 and M2, but does not apply to all transistors located in the circuitry. For example, as M3 is located in a feedback loop, the amplifier forces the two inputs to substantially the same voltage and corrects the amplifier's errors.

The present invention provides for a CMOS bandgap current and voltage generator that has a lower common input voltage than the corresponding input voltage of a bandgap reference source of the prior art.

An example of the type of improvement that may be achieved using the implementation of the present invention is set out below in Table 1, which summarises the performance of each of the circuits described herein. It will be understood that the Figures quoted therein are exemplary of the type of improvement that may be achieved and are not intended to limit the present invention to any one set of values.

| Circuit | Amp. Input voltage at room temperature [V] | Inherent gain in $\Delta V_{be}$ | Statistically compound output offset voltage |
|---|---|---|---|
| FIG. 1. Prior Art | 0.7 | 5 | 6 $V_{off}$ |
| FIG. 2 Prior Art | 1.4 | 2.5 | 3.5 $V_{off}$ |
| FIG. 3 | 0.6 | 2.5 | 3.54 $V_{off}$ |
| FIG. 4 | 1.2 | 1.67 | 2.04 $V_{off}$ |
| FIG. 5 | 1.8 | 1 | 1.41 $V_{off}$ |

As can be seen from comparison of FIG. 2 and the circuit of FIG. 3 of the present invention, that although the circuits may have the same statistical compound output offset voltage, the circuit of FIG. 3 is operating at lower supply voltage. Furthermore, the circuits of FIGS. 4 and 5 achieve a reduced statistical compound offset voltage, namely $2.04V_{off}$ and $1.41V_{off}$, when compared to the prior art circuits.

Statistical simulations were performed for the circuits of FIG. 1, FIG. 2 and FIG. 5. When all circuits were provided with similar conditions, the circuit of FIG. 1 displayed a "sigma" of 6.34 mV; the circuit of FIG. 2 a "sigma" of 4.92 mV, and the circuit of FIG. 5 a "sigma" of 2.29 mV.

Figure 6:
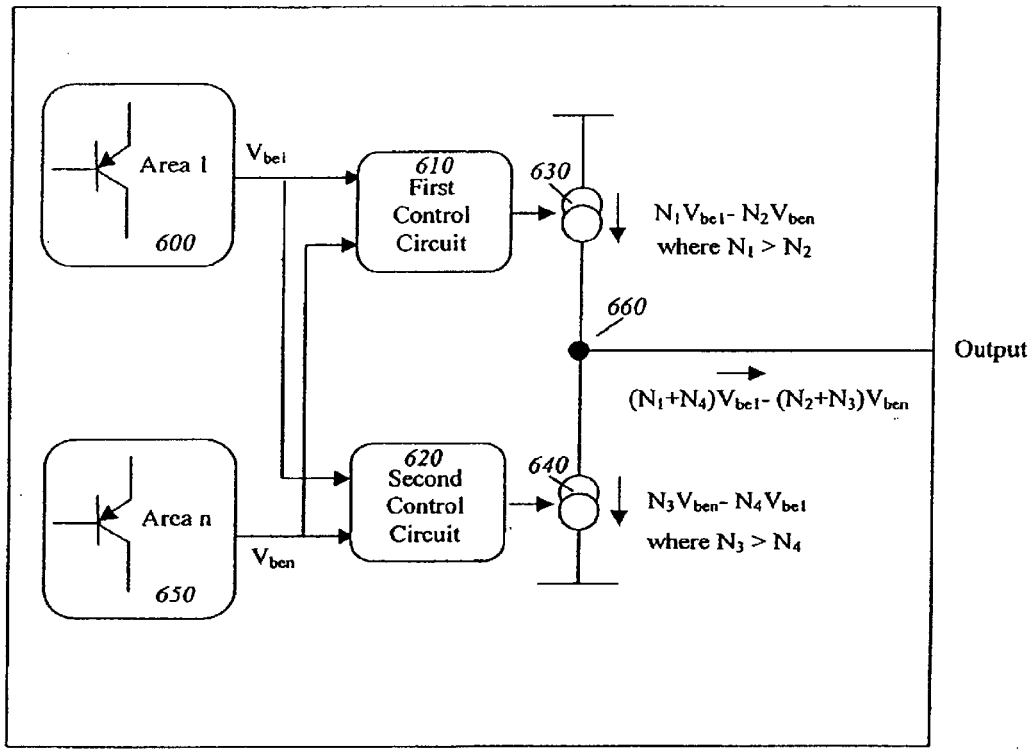
FIG. 6 shows in block form schematics of the circuitry according to the present invention.

It will be understood that the circuits of FIGS. 3 to 5 may be expressed in simplified functional blocks. An example of such a simplified circuit is shown in FIG. 6.

A first bipolar transistor circuit having one or more bipolar transistors which are operating at a high current density is provided in a first transistor block 600. The output of this transistor block 600 is fed to a first control circuit 610 and a second control circuit 620.

A second bipolar transistor circuit having one or more bipolar transistors which are operating at a lower current density than that of the first transistor block is provided in a second transistor block 650. The output of this transistor block 650 is also fed to the first control circuit 610 and the second control circuit 620.

The first control circuit 610 is adapted to control the current applied by a current source 630. Similarly, the second control circuit 620 is adapted to control the current provided by a current sink 640.

Each of the controlled outputs from the current source and current sink are coupled at an output node 660 to provide a combined output which is determined by the combination of the source and sink currents.

The output of the first transistor block provides a voltage output that is one or more multiples of the component bipolar transistor base emitter voltages $V_{be1}$. Similarly, the output of the second transistor block provides a voltage output that is one or more multiples of the component bipolar transistor base emitter voltages $V_{ben}$.

Each of these voltages are then scaled by their respective control circuits by values N1, N2, N3, and N4. By judicious choosing of these values, the output current can be provided in predominant PTAT, CTAT or combined PTAT/CTAT form. Desirably, N1>N2 and N3>N4. The combination of the first control circuit and the current source provides a current of the form $N1V_{be1}-N2V_{ben}$. Similarly, the combination of the second control circuit and the current sink provides a current of the form $N3V_{ben}-N4V_{be1}$. The output node combines these two currents to be of the form $(N1+N4)V_{be1}-(N2+N3)V_{ben}$.

Examples of the type of specific components for each of the blocks identified in FIG. 6 can be readily equated to the circuit components described previously in FIG. 3 to 5, and for the sake of brevity will not be specifically recited here.

It will be appreciated that in addition to the reduced offset contribution, the voltage reference source of the present invention also has the flexibility of enabling the output current to be set to any temperature coefficient, by simply scaling the ratio of resistor values by an appropriate amount.

Although the present invention has been described herein with reference to preferred embodiments it is not intended that the invention be in any way limited except as may be deemed necessary in the light of the appended claims.

What is claimed is:

1. A reference source comprising:

a first bipolar transistor circuit having one or more bipolar transistors for operation at a first, high current density to provide an output $V_{be1}$, a second bipolar transistor circuit having one or more bipolar transistors for operation at a second, lower current density than that of the first transistor block to provide an output. $V_{ben}$, a first control circuit, a second control circuit, a current source, and a current sink, wherein outputs of the first and second transistor circuits are fed to the first and second control circuits, the first control circuit being adapted to control the current provided by the current source and the second control circuit being adapted to control the current provided by the current sink, and outputs of the current source and current sink being combined to provide an output of the reference source.

2. The reference source as claimed in claim 1 wherein the current source and current sink provide outputs equal to a scaled difference between the outputs of the first and second transistor circuits.

3. The reference source as claimed in claim 2 wherein the output of the current source is defined by the equation:

$$N1V_{be1}-N2V_{ben}$$

where N1>N2, and the output of the current sink is defined by the equation $$N3V_{ben}-N4V_{be1}$$

where N3>N4.

4. The reference source as claimed in claim 3 wherein the output of the reference source is defined by the equation:

$$(N1+N4)V_{be1}-(N2+N3)V_{ben}.$$

5. The reference source as claimed in claim 1 wherein the first and second control circuits may be adapted to provide the output as a predominant PTAT or CTAT output.

6. The reference source as claimed in claim 1 wherein the output is provided as a current reference output.

7. The reference source as claimed in claim 1 wherein the output is provided as a voltage reference output.

8. The reference source as claimed in claim 5 wherein each of the first and second control circuits includes at least one amplifier.

9. The reference source as claimed in claim 8 wherein a first resistor is coupled to a non-inverting input of an amplifier of the first control circuit and a second resistor is coupled to an inverting input of an amplifier of the second control circuit, the ratio of the first and second resistors determining the predominance of PTAT to CTAT at the output.

10. The reference source as claimed in claim 1 wherein:

the first bipolar transistor circuit includes a stacked arrangement of transistors, and the first control circuit includes an amplifier, the stacked arrangement of transistors being coupled to the non-inverting input of the amplifier via a first resistor, and the output of the amplifier being coupled to a current mirror to provide the current provided by the current source.

11. The reference source as claimed in claim 10 wherein the output of the amplifier is coupled to a first pair of MOSFETs, the current provided at the first MOSFET of the pair by the amplifier being replicated to form an output of the second MOSFET of the pair, and the output of the second MOSFET being replicated across a current mirror, defined by a second pair of MOSFETs.

12. The reference source as claimed in claim 1 wherein the second bipolar transistor circuit is coupled to a non-inverting input of an amplifier component of the second control circuit, the output of the amplifier component controlling the gate of a MOSFET transistor to provide the current provided by the current sink.

13. The reference source as claimed in claim 1 wherein:

the first bipolar transistor circuit includes a stacked arrangement of transistors, the first control circuit includes an amplifier, the stacked arrangement of transistors being coupled to the non-inverting input of the amplifier via a first resistor, and the output of the amplifier being coupled to a current mirror to provide the current to the current source, the second bipolar transistor circuit is coupled to a non-inverting input of an amplifier component of the second control circuit, the output of the amplifier component controlling the gate of a MOSFET transistor to provide the current provided by the current sink, and the second bipolar transistor circuit is additionally coupled to the inverting input of the amplifier of the first control circuit.

14. The reference source as claimed in claim 1 wherein the circuit components are implemented in CMOS technology.

15. A method of providing a reference source for a circuit requiring a reference source, the method comprising:

providing a first bipolar transistor circuit having one of more bipolar transistors for operation at a high current density to provide an output $V_{be1}$, providing a second bipolar transistor circuit having one or more bipolar transistors for operation at a lower current density than that of the first transistor circuit to provide an output $V_{ben}$, providing a first control circuit, providing a second control circuit, providing a current source, and providing a current sink, wherein outputs of the first and second transistor circuits are fed to the first and second control circuits, the first control circuit being adapted to control the current provided by the current source and the second control circuit being adapted to control the current provided by the current sink, outputs of the current source and current sink being combined to form an output of the reference source, and the output of the reference source being provided to the circuit requiring the reference source.

16. The method of claim 15 wherein the current source and current sink provide outputs equal to a scale difference between the outputs of the firs and second transistor circuits.

17. The method of claim 16 wherein the output of the current source is defined by the equation:

$$N1V_{be1}-N2V_{ben}$$

where N1<N2, and the output of the current sink is defined by the equation $$N3V_{ben}-N4V_{be1}$$

where N3<N4.

18. The method of claim 17 wherein the output of the reference source is defined by the equation:

$$(N1N4)V_{be1}-(N2+N3)V_{ben}.$$

19. The method of claim 15 wherein the first and second control circuits may be adapted to provide the output as a predominant PTAT or CTAT output.

20. The method of claim 15 wherein the output of the reference source is provided as a current reference output.

21. The method of claim 15 wherein the output of the reference source is provided as a voltage reference output.

22. The method of claim 19 wherein each of the first and second circuits includes at least one amplifier.

23. The method of claim 22 further including coupling a first resistor to a non-inverting input of an amplifier of the first control circuit and coupling a second resistor to an inverting input of an amplifier of the second control circuit, the ratio of the first and second resistors determining the predominance of a PTAT to CTAT characteristic at the output of the reference source.

24. The method of claim 15 wherein:

the first bipolar transistor circuit includes a stacked arrangement of transistors; and the first control circuit includes an amplifier, the stacked arrangement of transistors being coupled to the non-inverting input of the amplifier via a first resistor, and the output of the amplifier being coupled to a current mirror to provide the current provided by the current source.

25. The method of claim 24 wherein the outpu of the amplifier is coupled to a first pair of MOSTFETs, the current provided at the first MOSFET of the pair by the amplifier being replicated to form an output of the second MOSFET of the pair, and the output of the second MOSFET being replicated across a current mirror, defined by a second pair of MOSFETs.

26. The method of claim 15 wherein the second bipolar transistor circuit is coupled to a non-inverting input of an amplifier component of the second control circuit, the output of the amplifier component controlling the gate of a MOSFET transistor to provide the current provided by the current sink.

27. The method of claim 15, wherein:

the first bipolar transistor circuit includes a stacked arrangement of transistors, the first control circuit includes an amplifier, the stacked arrangement of transistors being coupled to the non-inverting input of the amplifier via a first resistor, and the output of the amplifier being coupled to a current mirror to provide the current to the current source, the second bipolar transistor circuit is coupled to a non-inverting input of an amplifier component of the second control circuit, the outpu of the amplifier component controlling the gate of a MOSFET transistor to provide the current provided by the current sink, and the second bipolar transistor circuit is additionally coupled to the inverting input of the amplifier of the first control circuit.

28. The method of claim 15 wherein the circuit components are implemented in CMOS technology.

* * * * *